US009903152B2

(12) United States Patent
Jun

(10) Patent No.: US 9,903,152 B2
(45) Date of Patent: Feb. 27, 2018

(54) SUPER-INSULATING MULTI-LAYER GLASS

(71) Applicant: LG Hausys, Ltd., Seoul (KR)

(72) Inventor: Youn-Ki Jun, Gwacheon-si (KR)

(73) Assignee: LG HAUSYS, LTD., Seoul (KR)

( * ) Notice: Subject to any disclaimer, the term of this patent is extended or adjusted under 35 U.S.C. 154(b) by 178 days.

(21) Appl. No.: 14/441,011

(22) PCT Filed: Oct. 7, 2013

(86) PCT No.: PCT/KR2013/008944
§ 371 (c)(1),
(2) Date: May 6, 2015

(87) PCT Pub. No.: WO2014/073794
PCT Pub. Date: May 15, 2014

(65) Prior Publication Data

US 2015/0275567 A1 Oct. 1, 2015

(30) Foreign Application Priority Data

Nov. 9, 2012 (KR) ..... 10-2012-0126628

(51) Int. Cl.
*E06B 3/67* (2006.01)
*E06B 3/66* (2006.01)
*E06B 3/677* (2006.01)

(52) U.S. Cl.
CPC ..... *E06B 3/6715* (2013.01); *E06B 3/66* (2013.01); *E06B 3/6775* (2013.01)

(58) Field of Classification Search
CPC ..... E06B 3/66; E06B 3/6715; E06B 3/6775
See application file for complete search history.

(56) References Cited

U.S. PATENT DOCUMENTS 4,928,448 A * 5/1990 Phillip ..... E06B 3/6612 29/462
5,270,084 A * 12/1993 Parker ..... C03C 27/06 156/109

(Continued)

FOREIGN PATENT DOCUMENTS

CN 102257238 A 11/2011
DE 10258377 A1 6/2004
EP 2436865 A1 * 4/2012 ..... E06B 3/025

(Continued)

OTHER PUBLICATIONS

Machine translation of applicant cited DE 10258377, Jun. 2004.*

(Continued)

*Primary Examiner* — Donald J Loney
(74) *Attorney, Agent, or Firm* — Hauptman Ham, LLP

(57) ABSTRACT

A super-insulating multilayer glass comprises a first piece of glass and a second piece of glass which are spaced apart facing each other; a plurality of third pieces of glass which are formed spaced apart from each other between the first piece of glass and the second piece of glass, and which have a thickness of between 1 and 3 mm; filling gas layers which are respectively formed so as to comprise argon (Ar) gas, and of which at least 4 are formed among the first to third pieces of glass, to a thickness of between 11 and 13 mm between two neighboring pieces of glass; and a sealant which seals the side surfaces of the filled gas layers.

3 Claims, 1 Drawing Sheet

(56) References Cited

U.S. PATENT DOCUMENTS

| | | | | |
|---|---|---|---|---|
| 6,105,336 | A * | 8/2000 | Katoh | E06B 3/66 428/34 |
| 2011/0262694 | A1 | 10/2011 | Janssen et al. | |

FOREIGN PATENT DOCUMENTS

| | | | |
|---|---|---|---|
| FR | 2543608 | A1 | 10/1984 |
| JP | S59190243 | A | 10/1984 |
| JP | 10120447 | A | 5/1998 |
| JP | 3073130 | U | 11/2000 |
| JP | 2003335556 | A | 11/2003 |
| JP | 2006291608 | A | 10/2006 |
| JP | 2008545465 | A | 12/2008 |
| JP | 2009538812 | A | 11/2009 |
| JP | 2010006684 | A | 1/2010 |
| JP | 2010132497 | A | 6/2010 |
| JP | 2011084460 | A | 4/2011 |
| JP | 2011236083 | A | 11/2011 |
| JP | 2012051783 | A | 3/2012 |
| JP | 2012505984 | A | 3/2012 |
| WO | 2009118930 | A1 | 10/2009 |
| WO | 2010043828 | A1 | 4/2010 |

OTHER PUBLICATIONS

Korean Office Action issued on Aug. 27, 2015 in connection with the counterpart Korean Patent Application No. 10-2012-0126628.

Extended European Search Report dated Oct. 30, 2015 in connection with the counterpart European Patent Application No. 13852501.9.

International Search Report for PCT/KR2013/008944 dated Dec. 27, 2013.

Chinese Office Action dated Jan. 29, 2016 in connection with the counterpart Chinese Patent Application No. 01380058750.8.

* cited by examiner

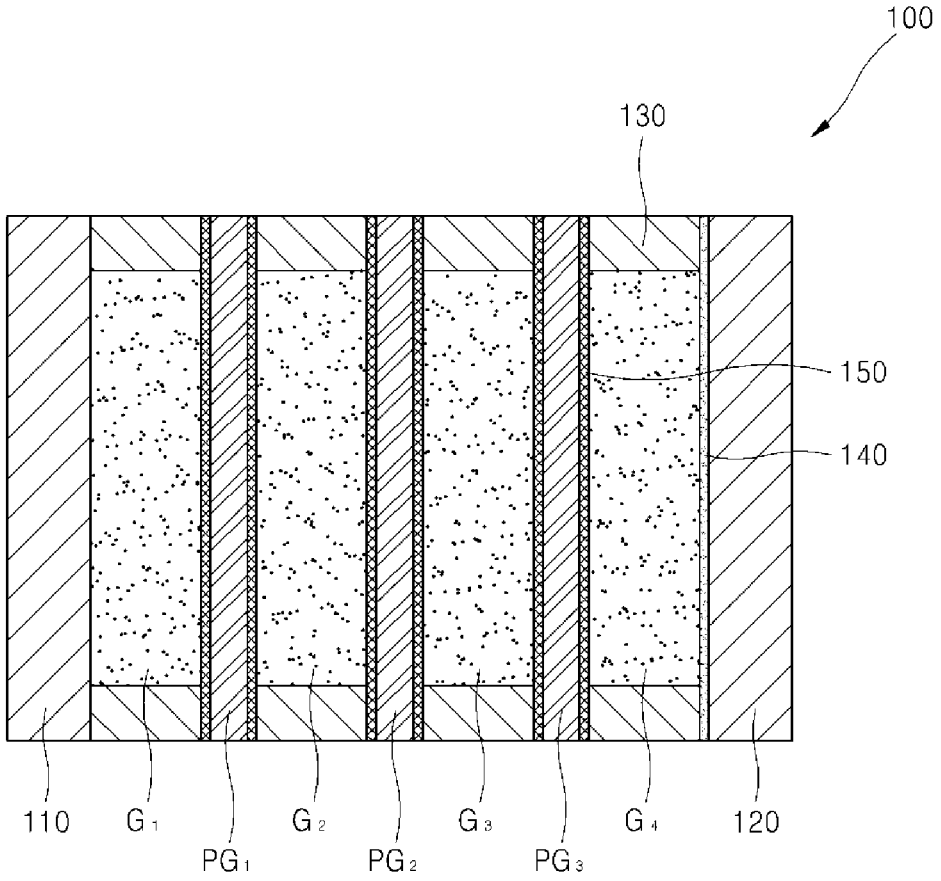
100
130
150
140
110
G1
PG1
G2
PG2
G3
PG3
G4
120

SUPER-INSULATING MULTI-LAYER GLASS

CROSS REFERENCE TO RELATED APPLICATION

This application claims the priority of Korean Patent Application No. 10-2012-0126628 filed on Nov. 9, 2012 in the Korean Patent and Trademark Office. Further, this application is the National Phase application of International Application No. PCT/KR2013/008944 filed on Oct. 7, 2013, which is incorporated herein by reference in its entirety.

TECHNICAL FIELD

The present invention relates to multilayer glass, and more particularly, to super-insulating multilayer glass exhibiting far superior heat insulation properties.

BACKGROUND ART

Although glass is an important material exhibiting transmittance with respect to light among materials constituting a building, since the glass has an extremely thin thickness and high density to secure transmittance as compared with a wall, heat insulation properties of glass are 1/10 or less those of a wall.

Since a typical sheet of glass has a thermal transmittance of greater than 5 $W/m^2K$, there are a lot of difficulties in energy saving due to heat leakage during heating and cooling.

Recently, multilayer glass (pair-glass) prepared by supplementing heat insulation properties of single glass has attracted attention. Currently, general multilayer glass composed of two sheets of glass has a thermal transmittance of about 2.7 $W/m^2K$ when using glass to which a heat insulation coating is not applied, and can secure heat insulation properties corresponding to a thermal transmittance of up to about 1.3 $W/m^2K$ when using glass to which a low-emissivity coating is applied and an inert gas such as argon (Ar) and the like as a filling gas.

However, the multilayer glass still has high thermal transmittance as compared with a wall generally having a thermal transmittance from about 0.4 $W/m^2K$ to about 0.5 $W/m^2K$. Recently, in the case of energy-saving houses, heat insulation properties corresponding to a thermal transmittance of glass of less than 0.7 $W/m^2K$ and to a thermal transmittance of 1.0 $W/m^2K$ in terms of a window including a window frame are required.

To satisfy such technical needs, vacuum glass capable of realizing heat insulation properties corresponding to a thermal transmittance of less than 0.7 $w/m^2K$ has been developed. However, since the vacuum glass is in a state in which a load of 7000 $kg/m^2$ is applied to a glass surface due to maintenance of a vacuum of about $10^{-3}$ torr between two sheets of glass, the vacuum glass is extremely sensitive to external stress, such as external impact, temperature non-uniformity due to heat accumulation and the like, and thus has a great possibility of breakage.

In addition, recently commercially available triple-layer glass has a thermal transmittance of 1.0 $W/m^2K$ or more, which falls short of target heat insulation properties, and has a low heat gain coefficient and has a difficulty in securing comfortable sight since the triple-layer glass exhibits reduced light transmittance and increased reflectance due to the three sheets of glass included therein.

In the related art, Japanese Patent Laid-Open Publication No. H10-120447 (publication date: May 12, 1998) discloses multilayer glass, in which several sheets of pane glass use a spacer around overall edges thereof and are disposed at intervals in a thickness direction, and in which a low-emissivity coating is formed on an outer surface of at least one sheet of pane glass out of sheets of pane glass mounted on the outermost sides.

DISCLOSURE

Technical Problem

It is an aspect of the present invention to provide super-insulating multilayer glass which exhibits far superior heat insulation properties by controlling a structure of glass sheets included therein.

Technical Solution

In accordance with one aspect of the present invention, super-insulating multilayer glass includes: first and second sheets of glass separated from each other to face each other; a plurality of third sheets of glass separated from each other and having a thickness of 1 mm to 3 mm; at least four filling gas layers each being formed to a thickness of 11 mm to 13 mm between two adjoining sheets of glass among the first to third sheets of glass and including argon (Ar) gas; and a sealant sealing lateral sides of the filling gas layers.

In accordance with another aspect of the present invention, a super-insulating multilayer glass includes: first and second sheets of glass separated from each other to face each other; a plurality of third sheets of glass separated from each other and having a thickness of 1 mm to 3 mm; at least four filling gas layers each being formed to a thickness of 6 mm to 10 mm between two adjoining sheets of glass among the first to third sheets of glass and including krypton (Kr) gas; and a sealant sealing lateral sides of the filling gas layers.

Advantageous Effects

According to the present invention, the super-insulating multilayer glass has the following effects.

First, since the at least four filling gas layers are formed to an optimal thickness between inner and outer sheets of glass, the super-insulating multilayer glass can realize a thermal transmittance of less than 0.7 $W/m^2K$ and thus exhibits far superior heat insulation properties.

Second, since a medium dividing the filling gas layers is a thin plate of glass having a thickness of 1 mm to 3 mm, the super-insulating multilayer glass can minimize thermal breakage due to partial incidence/absorption of sunlight while minimizing increase in overall weight thereof.

Third, the anti-reflective coating is applied to a surface of the thin plate of glass for dividing the filling gas layers, whereby the super-insulating multilayer glass allows comfortable sight to be secured by minimization of reduction in visible light transmittance due to multiple sheets of glass therein, and can maximize an effect of natural heating through inflow of sunlight indoors in winter by increase in a heat gain coefficient thereof.

Fourth, when the number of filling gas layers is increased through change of a structure of a window frame, the super-insulating multilayer glass can exhibit further improved heat insulation properties and thus is useful as a window for zero energy houses.

Fifth, since there is no vacuum pressure in the super-insulating multilayer glass unlike in vacuum glass, the super-insulating multilayer glass is structurally stable and thus has similar danger of breakage to general multilayer glass.

DESCRIPTION OF DRAWINGS

FIG. 1 is a sectional view of super-insulating multilayer glass according to one embodiment of the present invention.

BEST MODE

The above and other aspects, features, and advantages of the present invention will become apparent from the detailed description of the following embodiments in conjunction with the accompanying drawings. However, it should be understood that the present invention is not limited to the following embodiments and may be embodied in different ways, and that the embodiments are provided for complete disclosure and thorough understanding of the invention by those skilled in the art. The scope of the invention should be defined only by the accompanying claims and equivalents thereof. Like components will be denoted by like reference numerals throughout the specification.

Hereinafter, super-insulating multilayer glass exhibiting far superior heat insulation properties according to one embodiment of the present invention will be described in detail with reference to the accompanying drawings.

FIG. 1 is a sectional view of super-insulating multilayer glass according to one embodiment of the present invention.

Referring to FIG. 1, the illustrated super-insulating multilayer glass 100 includes a first sheet of glass 100, a second sheet of glass 120, three third sheets of glass $PG_1$ to $PG_3$, four filling gas layers $G_1$ to $G_4$, and a sealant 130.

In addition, the super-insulating multilayer glass 100 includes a low-emissivity coating layer 140 and a plurality of anti-reflective coating layers 150.

First, from the viewpoint of an overall shape, a pair of the first and second sheets of glass 110, 120 is separated from each other and faces each other. The three third sheets of glass $PG_1$ to $PG_3$ are separated from each other between the first and second sheets of glass 110, 120. The four filling gas layers $G_1$ to $G_4$ are formed between two adjoining sheets of glass among the first to third sheets of glass 110, 120, $PG_1$, $PG_2$, $PG_3$. In addition, the sealant 130 is formed at edges of the first to third sheets of glass 110, 120, $PG_1$ to $PG_3$ and seals lateral sides of the four filling gas layers $G_1$ to $G_4$.

Here, the first sheet of glass 110 may be an outer glass included in an outer wall of a building. Although the first sheet of glass 110 may be any glass used for construction, the first sheet of glass 110 may be typical soda-lime glass which is relatively low in price. According to the present invention, the first sheet of glass 110 has a thickness of 3 mm to 12 mm, preferably 5 mm to 8 mm.

On the other hand, the second sheet of glass 120 may be an inner glass mounted inside a building. Like the first sheet of glass 110, the second sheet of glass 120 may be any glass used for construction without limitation and may be typical soda-lime glass. According to the present invention, the second sheet of glass 120 has a thickness of 3 mm to 12 mm, preferably 5 mm to 8 mm.

If the thickness of the first and second sheets of glass 110, 120 is less than 3 mm, there is danger of breakage of the first and second sheets of glass due to wind pressure, and if the thickness of the first and second sheets of glass 110, 120 is greater than 12 mm, weight and cost of the final multilayer glass can be increased.

The third sheets of glass $PG_1$ to $PG_3$ are interposed between the first sheet of glass 110 and the second sheet of glass 120, and serve as a partition for dividing a space therebetween. Thus, the third sheets of glass $PG_1$ to $PG_3$ are also referred to as a partition glass.

The third sheets of glass $PG_1$ to $PG_3$ may have a thickness of 1 mm to 3 mm. In this case, increase in overall weight of the multilayer glass 100 can be minimized, and thermal breakage due to partial incidence or absorption of sunlight can be minimized.

However, if the thickness of the third sheets of glass $PG_1$ to $PG_3$ is less than 1 mm, space partition for formation of the plural filling gas layers $G_1$ to $G_4$ can be difficult. On the other hand, if the thickness of the third sheets of glass $PG_1$ to $PG_3$ is greater than 3 mm, the weight of the final multilayer glass can be increased, and an amount of energy of sunlight transmitted by the glass can be decreased. Reduction in sunlight energy deteriorates a heating effect by solar radiation in winter, and thus is a factor which increases heating cost of a building.

The third sheets of glass $PG_1$ to $PG_3$ may be any glass used for construction and may include typical soda-lime glass.

In addition, on surfaces of one side and the other side of the third sheets of glass $PG_1$ to $PG_3$, that is, between any one of the third sheets of glass $PG_1$ to $PG_3$ and any one of the filling gas layers $G_1$ to $G_4$ adjacent thereto, an anti-reflective coating layer 150 capable of preventing reflection of visible light, near-infrared light and the like may be further formed.

The anti-reflective coating layers 150 are divided into layers obtained by single coating of a low-refractive material having a lower index of refraction than glass and layers obtained by multilayer coating of high-refractive and low-refractive materials. Generally, a single-layer low-reflective film using a low-refractive material is applied for realization of low unit cost. The low-refractive material includes porous silicon oxide films ($SiO_2$), magnesium fluoride, and the like, without being limited thereto.

The anti-reflective coating layer 150 minimizes reduction in an amount of solar radiation due to light reflection at an interface between any one of the third sheets of glass $PG_1$ to $PG_3$ and any one of the filling gas layers $G_1$ to $G_4$ adjacent thereto.

The super-insulating multilayer glass 100 including the anti-reflective coating layer 150 applied thereto has an advantage in securing solar radiation since an interfacial reflectance thereof is reduced from 4% to about 1%, and has an advantage in securing comfortable sight since superposition of reflective images by the third sheets of glass $PG_1$ to $PG_3$ is also significantly reduced. In addition, the super-insulating multilayer glass 100 including the anti-reflective coating layer 150 has an increased heat gain coefficient and thus maximizes an effect of natural heating through inflow of sunlight indoors in winter.

The third sheets of glass $PG_1$ to $PG_3$, to which the anti-reflective coating layer 150 is applied, may be a commercial product applied as an outermost cover glass of solar cell panels.

The anti-reflective coating layer 150 may be formed using physical vapor deposition, chemical vapor deposition, wet coating and the like, without being limited thereto, and may be formed by a method known in the art.

The filling gas layers $G_1$ to $G_4$ are formed by gas filling spaces divided by the third sheets of glass $PG_1$ to $PG_3$, respectively, followed by sealing.

As described above, the filling gas layers $G_1$ to $G_4$ are formed between two adjoining sheets of glass among the first to third sheets of glass 110, 120, $PG_1$, $PG_2$, $PG_3$.

The filling gas layers $G_1$ to $G_4$ serve as a barrier for blocking heat transfer. Heat is transferred by three methods of radiation, convection and conduction, and since radiation allows heat to be transferred by propagation of electromagnetic waves, there is an insignificant effect of blocking heat transfer by radiation only by a multilayer structure of a pane glass. However, since the filling gas layers $G_1$ to $G_4$ are not influenced by convection due to external air, the filling gas layers $G_1$ to $G_4$ reduce heat transfer by convection to a meaningful level and also reduce heat transfer by conduction due to low thermal conductivity of air.

Here, thicknesses and kinds of constituent gases of the filling gas layers $G_1$ to $G_4$ have an influence on heat transfer properties of the multilayer glass. If the thickness of the filling gas layers $G_1$ to $G_4$ is decreased, although convection heat transfer is decreased due to reduction in a space for convection of sealed air, heat conduction heat is increased due to reduction in thickness through which the conduction is performed. Thus, the multilayer glass exhibit deteriorated heat insulation properties when the filling gas layers have a certain thickness or less.

On the contrary, if the thickness of the filling gas layers $G_1$ to $G_4$ is increased, since heat convection is increased despite reduction of heat conduction, the multilayer glass also exhibits deteriorated heat insulation properties. Therefore, there is an optimal thickness for realizing the best heat insulation properties.

A gas included in the filling gas layers $G_1$ to $G_4$ may include air, argon (Ar) and krypton (Kr), and heat insulation properties of the gas are improved with increasing molecular weight thereof. That is, heat insulation properties are, in increasing order, krypton (Kr)>argon (Ar)>air. The reason is that, since more energy is generally required for movement of gas particles with increasing weight and viscosity of the particles, convection is reduced.

Thus, to improve heat insulation properties, the filling gas layers $G_1$ to $G_4$ may include 50% or more of argon (Ar) gas which is a main gas, preferably 85% to 95% of argon (Ar) gas and 5% to 15% of air, more preferably 90% of argon (Ar) gas and 10% of air. In this case, the filling gas layers $G_1$ to $G_4$ may be formed to an optimized thickness for argon (Ar) gas, that is, a thickness of 11 mm to 13 mm, preferably 12 mm, so as to realize the minimum thermal transmittance (Ug).

Alternatively, the filling gas layers $G_1$ to $G_4$ may include 50% or more krypton (Kr) gas which is a main gas, preferably 85% to 95% of krypton (Kr) gas and 5% to 15% of air, more preferably 90% of krypton (Kr) gas and 10% of air. In this case, the filling gas layers $G_1$ to $G_4$ may be formed to an optimized thickness for krypton (Kr) gas, that is, a thickness of 6 mm to 10 mm, preferably 8 mm so as to realize the minimum thermal transmittance (Ug).

If the thickness of the filling gas layers $G_1$ to $G_4$ is not within the optimized thickness range for each of argon (Ar) gas and krypton (Kr) gas, the multilayer glass 100 can exhibit deteriorated heat insulation properties as described above.

In addition, if the amount of argon gas or krypton gas is less than 85%, heat insulation properties of the multilayer glass can be deteriorated due to increase in convection. On the other hand, if the amount of argon gas or krypton gas is greater than 95%, costs can be increased without further increase in heat insulation properties of the multilayer glass.

According to the present invention, a target thermal transmittance (Ug) of the super-insulating multilayer glass 100 is less than 0.7 $W/m^2K$. This is determined considering that vacuum multilayer glass exhibiting the best heat insulation properties among existing heat-insulating glass has a thermal transmittance (Ug) from about 0.7 $W/m^2K$ to 0.9 $W/m^2K$.

To satisfy this, as shown in FIG. 1, at least four filling gas layers $G_1$ to $G_4$ may be formed while constituent gases and thicknesses of the filling gas layers $G_1$ to $G_4$ and thicknesses of the third glasses $PG_1$ to $PG_3$ are maintained within the ranges as set forth above. The reason is that the minimum number of filling gas layers for realization of heat insulation properties satisfying the target thermal transmittance (Ug) is 4.

Although the multilayer glass has been illustrated as including the four filling gas layers $G_1$ to $G_4$ in FIG. 1 for convenience of description, it should be understood that the present invention is not limited thereto.

Under the precondition of maintaining a constant thickness of the filling gas layers, since thermal transmittance (Ug) can be continuously decreased as the number of filling gas layers is increased, various forms of the multilayer glass may be manufactured by adjusting the number of filling gas layers based on a heat insulation target of a building. In this case, at least four filling gas layers may be formed between one third sheet of glass and the other third sheet of glass adjacent thereto and between each of the first and second sheets of glass and one third sheet of glass adjacent thereto.

As such, when the number of filling gas layers is increased through change of a structure of a window frame, the multilayer glass can exhibit further improved heat insulation properties and is meaningful as a window for zero energy houses.

The filling gas layers $G_1$ to $G_4$ may be formed by filling a space divided by the third sheets of glass $PG_1$ to $PG_3$ with argon gas or krypton gas through an injection hole (not shown) formed on one region of the sealant 130 using a method known in the art, followed by sealing the injection hole, without being limited thereto.

The sealant 130 is formed at edges between two adjoining sheets of glass among the first to third sheets of glass 110, 120, PG1, PG2, PG3 and seals lateral sides of the filling gas layers.

The sealant 130 allows two sheets of glass, which face each other with a constant gap defined therebetween, to maintain the constant gap such that the gap corresponds to the thickness of the filling gas layers $G_1$ to $G_4$, and flexibly and hermetically seals the edges of the first to third sheets of glass 110, 120, $PG_1$ to $PG_3$.

The sealant 130 may be generally divided into a primary sealant (not shown) and a secondary sealant (not shown), and the primary sealant is a material having short bonding time in order to maintain the gap between the sheets of glass and to prevent primary leakage of an injected heat-insulating gas during a manufacturing process of the multilayer glass. For example, the primary sealant may be polyisobutylene. The secondary sealant serves to completely seal an air layer inside the multilayer glass and preventing inflow of external air even during long-term use of the multilayer glass. For example, the secondary sealant may include at least one selected from among polysulfide, silicone-based adhesives, and polyurethane.

In addition, the sealant 130 may include a moisture absorbent in order to remove moisture included in the internal filling gas layers $G_1$ to $G_4$ after processing of the multilayer glass, and the moisture absorbent may include at least one selected from among silica gel, calcium chloride, activated alumina, and the like.

According to the present invention, the super-insulating multilayer glass 100 may further include a low-emissivity coating layer 140 formed on an inner surface of the second sheet of glass 120, that is, between the second sheet of glass 120 and the filling gas layer $G_4$ adjacent thereto.

Since the low-emissivity coating layer 140 exhibits low emissivity for far-infrared light, the low-emissivity coating layer 140 is capable of improving heat insulation properties by blocking far-infrared radiant energy in a long wavelength region (2.5 μm to 50 μm). Here, the low-emissivity coating layer 140 may have a vertical emissivity from about 3% to 15%. Here, the emissivity refers to a degree of absorption of infrared energy in an infrared wavelength region.

For example, the low-emissivity coating layer 140 may be formed of any one selected from among silver (Ag), copper (Cu), gold (Au), aluminum (Al), indium tin oxide (ITO), fluorine-doped tin oxide (FTO) and the like, or may be formed by applying a sandwich structure film of dielectric/silver (Ag)/dielectric or the like. The dielectric may include metal (oxy)nitrides such as $SnZnO_xN_y$, $SnZnN_x$, and the like. In addition, a wide range of techniques for low-emissivity coating are known in the art, and according to the present invention, low-emissivity coating already known in the art is applied to the inner surface of the second glass 120.

That is, when the low-emissivity coating layer 140 is applied to the inner surface of the second sheet of glass 120, heat transfer by radiation, which is not blocked by the filling gas layers $G_1$ to $G_4$, is additionally blocked, thereby improving heat insulation properties of the multilayer glass.

As such, the second sheet of glass 120 including the low-emissivity coating layer 140 on one surface thereof is referred to as low-emissivity low-e glass. The low-emissivity low-e glass reflects solar radiation in summer and traps infrared light generated from an indoor heater in winter, thereby reducing energy consumption of a building.

The low-emissivity coating layer 140 may be formed by direct coating or deposition of the materials as set forth above onto the surface of the second sheet of glass 120 using typical sputtering, chemical vapor deposition (CVD), spray coating, or the like.

As described above, the super-insulating multilayer glass 100 according to the present invention includes the at least four filling gas layers formed to an optimal thickness, and thus can realize a thermal transmittance of less than 0.7 $W/m^2K$ and a thermal transmittance of about 0.5 $W/m^2K$, which is similar to that of a wall. Thus, the super-insulating multilayer glass 100 according to the present invention exhibits far superior heat insulation properties.

In addition, since there is no vacuum pressure in the super-insulating multilayer glass 100 unlike in vacuum glass, the super-insulating multilayer glass 100 is structurally stable and thus has similar danger of breakage to general multilayer glass.

EXAMPLE

Next, the present invention will be explained in more detail with reference to some examples. It should be understood that these examples are provided for illustration only and are not to be construed in any way as limiting the present invention.

A description of details apparent to those skilled in the art will be omitted for clarity.

1. Manufacture of Specimen

Sheets of multilayer glass of Examples 1 to 3 and Comparative Examples 1 to 4, which had structures as listed in Table 1 were manufactured, respectively.

TABLE 1

| | Filling gas layer | | | Partition glass | | | Inner glass | | Outer glass | |
|---|---|---|---|---|---|---|---|---|---|---|
| | Number | Thick. (mm) | Constitution (%) | Number | Thick. (mm) | Anti-reflective coating layer | Thick. (mm) | Low-emissivity coating layer | Thick. (mm) | Low-emissivity coating layer |
| Example 1 | 4 | 12 | Ar 90 + Air 10 | 3 | 2 | Presence | 6 | Presence | 6 | None |
| Example 2 | 4 | 12 | Ar 90 + Air 10 | 3 | 2 | None | 6 | Presence | 6 | None |
| Example 3 | 9 | 12 | Ar 90 + Air 10 | 8 | 2 | Presence | 6 | Presence | 6 | None |
| Comparative Example 1 | 1 | 12 | Ar 90 + Air 10 | 0 | — | — | 6 | Presence | 6 | None |
| Comparative Example 2 | 2 | 12 | Ar 90 + Air 10 | 1 | 6 | None | 6 | Presence | 6 | None |
| Comparative Example 3 | 3 | 12 | Ar 90 + Air 10 | 2 | 6 | None | 6 | Presence | 6 | None |
| Comparative Example 4 | 4 | 12 | Ar 90 + Air 10 | 3 | 6 | None | 6 | Presence | 6 | None |

That is, the inner glass was formed as a sheet of low-emissivity low-e glass including a low-emissivity coating layer, which had an emissivity of 3% and was formed on a contact surface in contact with the filling gas layer, and having a thickness of 6 mm.

2. Property Evaluation

Table 2 shows measurement results of thermal transmittance (Ug), solar heat gain coefficient (SHGC, g-value), visible light transmittance, glass inner surface temperature and glass outer surface temperature of each of the prepared specimens of the sheets of multilayer glass of Examples 1 to 3 and Comparative Examples 1 to 4.

Here, values in Table 2 are results calculated in accordance with NFRC 100-2010; as for conditions of indoor and outdoor air temperature upon calculation of thermal transmittance (Ug) and glass surface temperature, an outdoor air temperature was set to −18° C. and an indoor air temperature was set to 21° C.; and as for conditions of indoor and outdoor air temperature upon calculation of solar heat gain coefficient (g-value), an outdoor air temperature was set to 32° C. and an indoor air temperature was set to 24° C.

TABLE 2

| | Thermal transmittance (Ug) ($W/m^2K$) | Solar heat gain coefficient (SHGC, g-value) | Visible light transmittance (%) | Glass inner surface temperature (° C.) | Glass outer surface temperature (° C.) |
|---|---|---|---|---|---|
| Example 1 | 0.669 | 0.483 | 76.5 | −17.1 | 17.1 |
| Example 2 | 0.669 | 0.483 | 60.5 | −17.1 | 17.1 |
| Example 3 | 0.384 | 0.418 | 73.9 | −17.5 | 18.7 |
| Comparative Example 1 | 1.383 | 0.554 | 78.1 | −16.2 | 13.4 |
| Comparative Example 2 | 0.992 | 0.488 | 69.7 | −16.7 | 15.4 |
| Comparative Example 3 | 0.792 | 0.441 | 62.5 | −16.9 | 16.5 |
| Comparative Example 4 | 0.666 | 0.403 | 56.2 | −17.1 | 17.2 |

Referring to Tables 1 and 2, from comparison of the results of Examples 1 to 3 and Comparative Examples 1 to 4, it could be seen that the thermal transmittance (Ug) was decreased with increasing number of filling gas layers, and that the thermal transmittance (Ug) of less than 0.7 $m^2K$ was satisfied when the number of filling gas layers was at least 4.

It could be seen that the specimens of Examples 1 and 3, in which the anti-reflective coating layer was formed, exhibited higher visible light transmittance than those of Comparative Examples 1 to 4, in which the anti-reflective coating layer was not formed.

In addition, the specimens of Examples 1 to 3 and Comparative Example 4, which included at least four filling gas layers, exhibited better heat insulation properties than those of Comparative Examples 1 to 3, which included less than four filling gas layers, and the specimen of Example 3, which included the greatest number of filling gas layers, exhibited the best heat insulation properties.

Although the present invention has been described with reference to some embodiments, it should be understood that the foregoing embodiments are provided for illustration only, and that various modifications, changes, alterations, and equivalent embodiments can be made by those skilled in the art without departing from the spirit and scope of the invention. Therefore, the scope of the invention should be limited only by the accompanying claims and equivalents thereof.

LIST OF REFERENCE NUMERALS

100: Super-insulating multilayer glass
110: First sheet of glass
120: Second sheet of glass
$PG_1$ to $PG_3$: Third sheets of glass
$G_1$ to $G_4$: Filling gas layers
130: Sealant
140: Low-emissivity coating layer
150: Anti-reflective coating layer

The invention claimed is:

1. Super-insulating multilayer glass comprising:

at least five sheets of glass parallel to and separated from each other, wherein the at least five sheets of glass comprises:

first and second sheets of glass facing each other, wherein each of the first sheet of glass and the second sheet of glass has a thickness ranging from 5 mm to 8 mm;

a plurality of third sheets of glass between the first and second sheets of glass, wherein each third sheet of glass of the plurality of third sheets of glass has a thickness ranging from 1 mm to 3 mm, at least one third sheet of glass of the plurality of third sheets of glass comprises an anti-reflective coating layer on a surface thereof, and the anti-reflective coating layer comprises porous silicon oxide or magnesium fluoride;

at least four filling gas layers each being formed to a thickness of 6 mm to 10 mm between two adjoining sheets of glass among the first to third sheets of glass and comprising krypton (Kr) gas; and a sealant sealing lateral sides of the filling gas layers, wherein the super-insulating multilayer glass has a thermal transmittance of less than 0.7 $W/m^2K$.

2. The multilayer glass according to claim 1, wherein the filling gas layers comprise 85% to 95% of argon gas and 5% to 15% of air.

3. The multilayer glass according to claim 1, further comprising:

a low-emissivity coating layer formed between the second sheet of glass and the filling gas layer adjacent thereto.

* * * * *